US006421518B1

(12) United States Patent
Floyd et al.

(10) Patent No.: US 6,421,518 B1
(45) Date of Patent: Jul. 16, 2002

(54) TONER LOADING SYSTEM

(75) Inventors: Rebecca Floyd, Filton (GB); Andrew Michael South, Ebina (JP); Michael Gerald Ladell, Milton Keynes; Shaun Hutchinson, Northfield, both of (GB)

(73) Assignee: Xerox Corporation, Stamford, CT (US)

( * ) Notice: Subject to any disclaimer, the term of this patent is extended or adjusted under 35 U.S.C. 154(b) by 44 days.

(21) Appl. No.: 09/722,638

(22) Filed: Nov. 28, 2000

(51) Int. Cl.[7] ..... G03G 15/08
(52) U.S. Cl. ..... 399/258; 399/262
(58) Field of Search ..... 399/258, 260, 399/262

(56) References Cited

U.S. PATENT DOCUMENTS 4,603,714 A * 8/1986 Marotta ..... 141/383

FOREIGN PATENT DOCUMENTS

JP 59-102260 * 6/1984
JP 61-22369 * 1/1986

* cited by examiner

*Primary Examiner*—Quana M. Grainger

(74) *Attorney, Agent, or Firm*—Oliff & Berridge, PLC

(57) ABSTRACT

A toner loading system for an image forming apparatus includes a valve for a toner bottle and a valve opening member on a toner hopper of the image forming apparatus. The valve includes a first valve member non-rotatably secured to an opening of the toner bottle and a second valve member rotatably secured to the first valve member. The first and second valve members each include tabs and apertures. When the tabs of the first and second valve members are aligned the apertures of the first and second valve members do not overlap and no toner may be dispensed from the toner bottle. The toner bottle is engaged with the valve opening member on the toner hopper to dispense the toner. The valve opening member prevents rotation of the second valve member with respect to the hopper and permits rotation of the first valve member and the toner bottle with respect to the toner hopper. Rotation of the first valve member relative to the second valve member in a first direction causes the tabs to move out of alignment and the aperture of the first valve member to overlap the aperture of the second valve member, allowing dispensing of the toner. The valve opening member prevents disengagement of the toner bottle from the toner hopper while the valve is open, thus preventing spilling of the toner. Rotation of the first valve member relative to the second valve member in a second direction opposite to the first direction moves the tabs back into alignment and closes the valve. The toner bottle may then be disengaged from the valve opening member.

27 Claims, 11 Drawing Sheets

TONER LOADING SYSTEM

BACKGROUND OF THE INVENTION

1. Field of Invention

This invention relates generally to a system for loading toner in an image forming apparatus.

2. Description of Related Art

In conventional image forming apparatus, toner is used to form an image or images on a sheet or sheets of recording medium. An image forming member, such as a photoreceptor formed of a photosensitive material, is uniformly charged by a charging device. An electrostatic latent image is formed on the image forming member. A developing device supplies toner to the latent image formed on the image forming member to form a toner image.

Toner is supplied to the developing device from a toner source. The toner source may be a toner reservoir or hopper. Toner must be resupplied to the toner hopper when the level of toner in the hopper falls below a specified level. The toner is usually packaged and supplied in bottles or containers having a lid or cap. In order to resupply the toner hopper, the operator must remove the cap of the toner bottle and pour the toner from the bottle into the hopper. The toner often spills from the bottle prior to fitting the bottle opening to the hopper opening. During supply of the toner, the toner bottle must be moved back and forth across the hopper to evenly distribute the toner. During the back and forth movement of the toner bottle, the bottle may disengage from the hopper and toner may spill out of the bottle. The toner may also spill if the operator removes the toner bottle from the hopper before the toner bottle is empty. Even if the bottle is mostly empty, when the operator removes the bottle from the hopper, residual toner may spill or puff out of the bottle and soil the operator, the hopper, and/or the image forming apparatus.

SUMMARY OF THE INVENTION

The toner loading system according to the invention allows loading of toner without removing the cap or lid of the toner bottle. According to various exemplary embodiments the toner loading system, toner bottle and toner hopper according to the invention, the toner loading system includes a toner bottle fitted with a toner bottle valve that controls dispensing of the toner. The toner bottle valve includes a first valve member that is non-rotatably engageable with the opening of the toner bottle. The first valve member includes an aperture for dispensing the toner. A second valve member is rotatably secured to the first valve member and seals the aperture of the first valve member. The second valve member includes an aperture that may overlap the aperture of the first valve member to allow dispensing of the toner from the toner container. The first and second valve members each include a tab. The aperture of the first valve member does not overlap the aperture of the second valve member, and the toner may not be dispensed, when the tab of the first valve member is aligned with the tab of the second valve member.

In various exemplary embodiments of the toner loading system, toner bottle and toner hopper according to this invention, the toner bottle, including the first and second valve members, is engageable with a valve opening member that is slidably supported on the toner hopper. The tabs of the first and second valve members are received in a recess of the valve opening member. In a first exemplary embodiment of the toner loading system, toner bottle and toner hopper according to the invention, the valve opening member is a toner hopper adaptor that includes an annular projection including a slot having a groove extending from the slot. The tabs of the first and second valve members engage the slot. The tab of the second valve member is blocked from rotation by the slot while the tab of the first valve member may rotate in the groove. Rotating the toner bottle, and thus the first valve member, causes the apertures of the first valve member to overlap the apertures of the second valve member and allows toner to be dispensed from the toner bottle. The tab of the first valve member is held in the groove and prevents the bottle from being removed from the toner hopper adaptor during dispensing of the toner and thus prevents spillage of the toner.

In a second exemplary embodiment of the toner loading system, toner bottle and toner hopper according to the invention, the valve opening member is a toner hopper slider that includes a plurality of retaining stops on a bottom surface for engaging the tabs of the first and second valve members. A first retaining stop engages the tab of the second valve member to prevent rotation of the second valve member. A second retaining stop is offset circumferentially from the first retaining stop and engages the tab of the first valve member to stop rotation of the first valve member. When the first and second retaining stops engage the tabs of the first and second valve members, the apertures of the first and second valve members overlap and toner can be dispensed from the toner bottle. A release stop engages the tabs of the first and second valve members when the toner bottle is rotated to close the toner bottle valve. Thus, the release stops rotation of the first and second valve members relative to each other such that the apertures of the first and second valve members do not overlap and permits the toner bottle to be removed from the toner hopper slider.

In a third exemplary embodiment of the toner loading system, toner bottle and toner hopper according to the invention, a cap is provided over the second valve member. The cap aligns the first and second valve members during transit and storage of the toner bottle so that toner may not be dispensed from the toner bottle. The cap includes a lever that is connected to the first valve member. The connection between the first valve member and the lever may be broken by pivoting the lever. The cap may then be removed from the second valve member and the toner bottle may be engaged with the valve opening member to dispense the toner.

Various exemplary embodiments of the toner loading system, toner bottle and toner hopper according to this invention may be adapted for use with existing image forming apparatus that use toner to form images. Various exemplary embodiments of the toner loading systems according to the invention prevent spillage of the toner by sealing the toner bottle until the toner bottle is securely engaged with the valve opening member of the toner hopper and the toner bottle is rotated. Various exemplary embodiments of the toner loading systems according to this invention also prevent spillage by supporting the toner bottle while it is being translated to distribute the toner and preventing the toner bottle from disengaging the hopper while the valve is open.

Other features of the invention will become apparent as the following description proceeds and upon reference to the drawings.

BRIEF DESCRIPTION OF THE DRAWINGS

Various exemplary embodiments of this invention will be described in detail with reference to the following figures, wherein like numerals reference like elements, and wherein.

DESCRIPTION OF THE PREFERRED EMBODIMENTS

Figure 1:
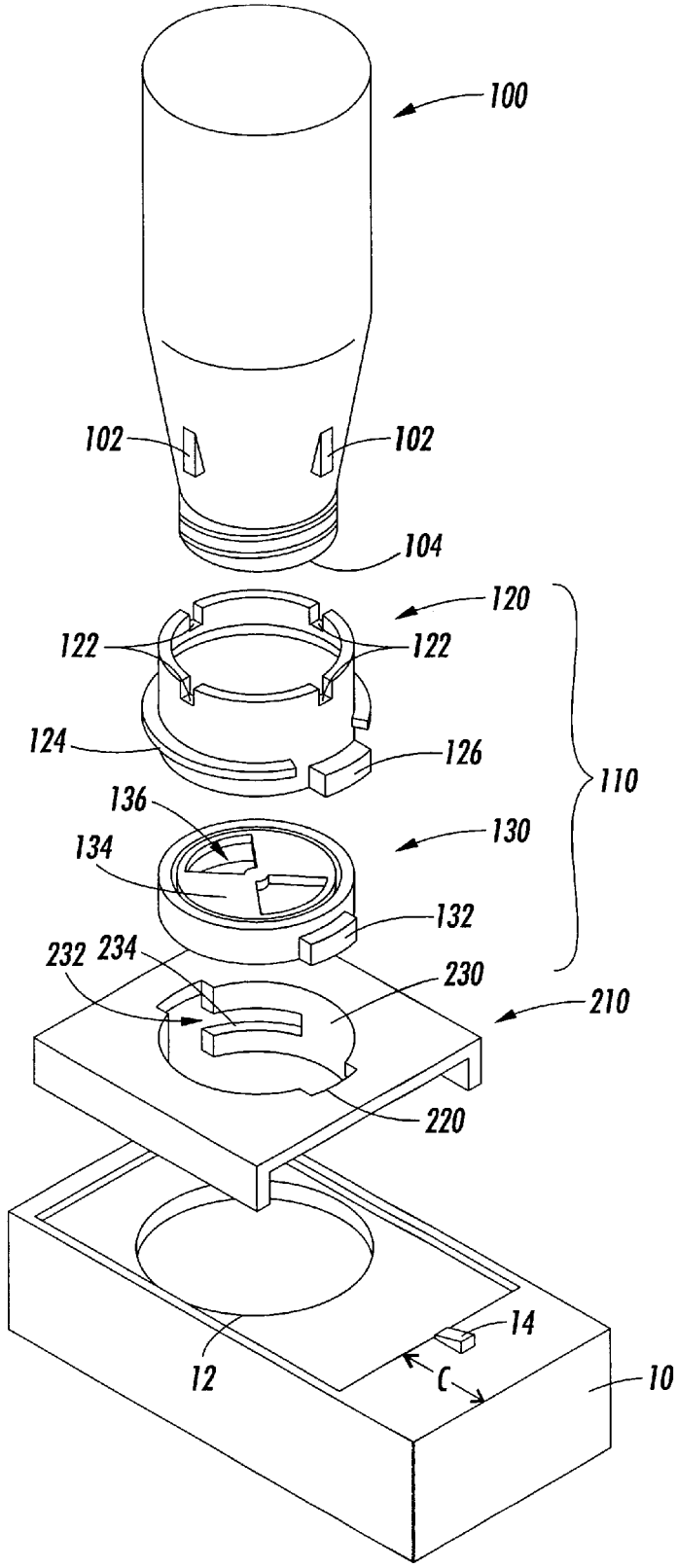
FIG. 1 is an exploded assembly view of a first exemplary embodiment of a toner loading system according to the invention.

Referring to FIG. 1, in a first exemplary embodiment, a toner loading system according to the invention includes a toner bottle 100 that includes a plurality of projections 102. Although not shown in FIG. 1, it should be appreciated that the toner bottle 100 can also include a number of projections 102 on the far side of the toner bottle. The projections 102 engage notches 122 of a first valve member 120 of a toner bottle valve 110 to secure the first valve member 120 non-rotatably over the opening 104 of the toner bottle 100. The first valve member 120 has a pair of tabs 126 (only one of which is shown in FIG. 1) and an annular shelf 124.

A second valve member 130 of the toner bottle valve 110 is rotatably secured in the first valve member 120. The second valve member 130 may be snap fit into the first valve member 120 so that the second valve member 130 is rotatable relative to the first valve member 120. The second valve member 130 may include an annular ridge on its outer circumference that mates with an annular groove on the inner circumference of the first valve member 120, or vice versa. It should be appreciated that any known or later developed mating connection that allows the second valve member 130 to be secured to the first valve member 120 so that the second valve member 130 is rotatable relative to the first valve member 120 may be used.

Figure 2:
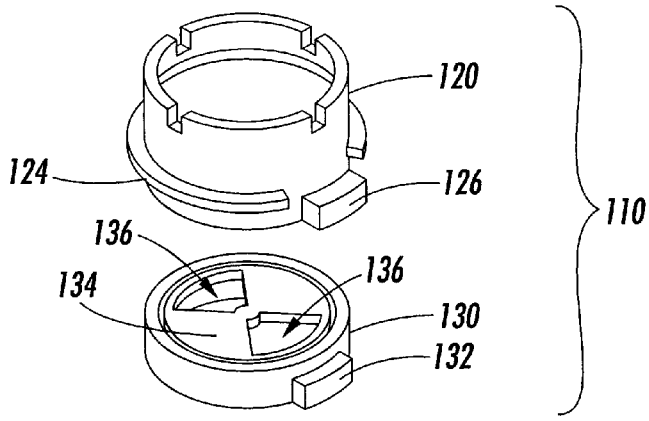
FIG. 2 is an exploded assembly view of a first exemplary embodiment of the toner bottle valve, including the first and second valve members, according to the invention.
Figure 4:
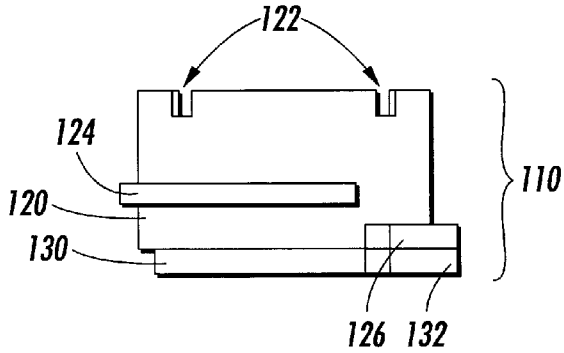
FIG. 4 is a side view of a first exemplary embodiment of the toner bottle valve, including the first and second valve members, according to the invention, showing the second valve member inserted into the first valve member.

The second valve member 130 includes a pair of tabs 132 (only one shown in FIG. 1) and a pair of apertures 136. As shown in FIG. 2, apertures 128 in the first valve member 120 do not overlap the apertures 136 in the second valve member 130 when the tabs 132 of the second valve member 130 are aligned with the tabs 126 of the first valve member 120. This orientation is shown in FIGS. 2 and 4. When the tabs 126 and 132 are aligned and the apertures 128 and 136 do not overlap, no toner may be dispensed from the toner bottle 100. Although the first and second valve members 120 and 130 have been shown and described with two tabs each, it should be appreciated that any number of tabs may be used.

Figure 3:
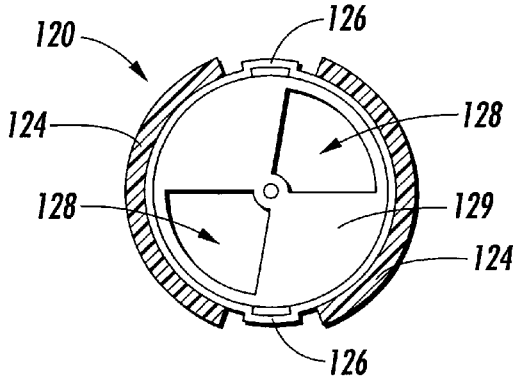
FIG. 3 is a sectional plan view of a first exemplary embodiment of the first valve member according to the invention.

As shown in FIG. 3, the apertures 128 of the first valve member 120 are each less than 90° of the circumference of the first valve member 120. The apertures 136 of the second valve member 130 are also less than 90° of the circumference of the second valve member 130. This ensures that a complete seal is formed when the apertures 128 and 136 are not overlapping and the tabs 126 and 132 are aligned. Although the first and second valve members 120 and 130 have been shown with two apertures, it should be appreciated that the first and second valve members 120 and 130 may include any number of corresponding apertures with the angular extents of the apertures adjusted correspondingly to ensure that a complete seal is formed.

As shown in FIGS. 1 and 2, the second valve member 130 includes a surface member 134 in which the apertures 136 are formed. The surface member 134 may have a convex shape. As shown in FIG. 3, the first valve member 120 includes a flexible surface member 129 in which the apertures 128 are formed. The convex surface member 134 engages and stretches the flexible surface member 129 to ensure the seal between the first and second valve members 120 and 130. It should be appreciated that the convex surface member may be provided on the first valve member instead of the second valve member and that the flexible surface member may be provided on the second valve member instead of the first valve member.

Referring again to FIG. 1, in the first exemplary embodiment of the toner loading system according to the invention, a toner hopper adaptor 210 is secured to an existing hopper slider 14 that is slidably supported on a toner hopper 10 of an image forming apparatus. The hopper slider 14 is slidable in the direction of arrow C on the toner hopper 10. The toner hopper adaptor 210 may be snap fit to the hopper slider 14 so that the toner hopper adaptor 210 is slidable with the hopper slider 14 on the toner hopper 10. It should be appreciated that the toner hopper adaptor 210 may be secured to the hopper slider 14 by any known or later developed mating connection that secures the toner hopper adaptor 210 to the hopper slider 14 and allows the toner hopper adaptor 210 to slide with the hopper slider 14 on the toner hopper 10.

Figure 6:
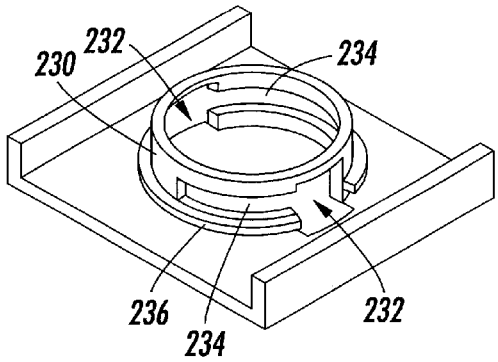
FIG. 6 is a perspective view of a bottom of the toner hopper adaptor of FIG. 5.

As shown in FIG. 6, the toner hopper adaptor 210 includes an annular projection 230 that fits within an aperture 12 of the hopper slider 14. The annular projection 230 may include an annular ridge 236 that has a diameter slightly larger than the diameter of the aperture 12 of the hopper slider 14. The annular ridge 236 is snap fit within the aperture 12 to secure the toner hopper adaptor 210 to the hopper slider 14. It should be appreciated, however, that the toner hopper adaptor 210 may be secured to a non-sliding member or to an opening in the toner hopper 10 to allow filling of the toner hopper 10.

Figure 5:
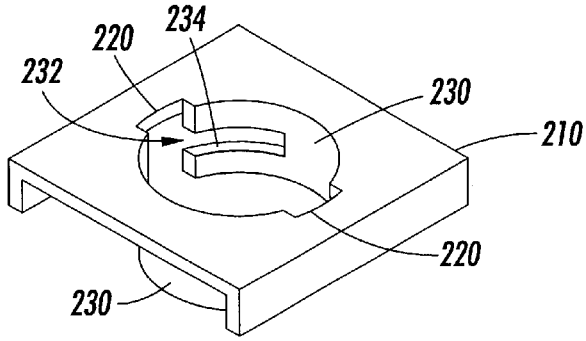
FIG. 5 is a perspective view of a first exemplary embodiment of a top of a toner hopper adaptor according to the invention.

Referring to FIGS. 5 and 6, the toner hopper adaptor 210 includes a number of recesses 220 equal to the number of tabs 126/132. The tabs 126 and 132 of the first and second valve members 120 and 130, respectively, fit into the recesses 220 when the tabs 126 and 132 are aligned. A like number of slots 232 are formed in the annular projection 230 at positions corresponding to the recesses 220. A groove 234 extends from each slot 232 so that a total angular extent of the slot 232 and the groove 234 is approximately 90°, for embodiments that have two slots, or a corresponding angular extent for embodiments that have more than two slots.

Figure 7:
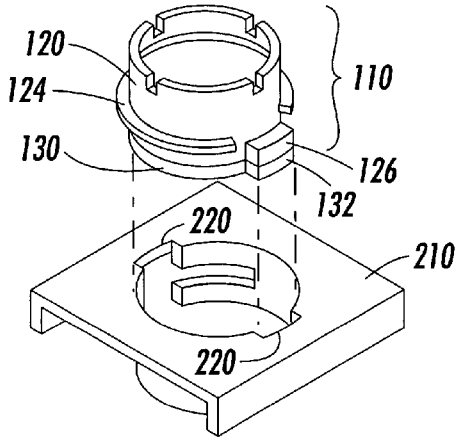
FIG 7 is a perspective view of the first exemplary embodiment of the toner bottle valve and the top of the toner hopper adaptor of the invention prior to engaging the toner bottle valve with the toner hopper adaptor.
Figure 8:
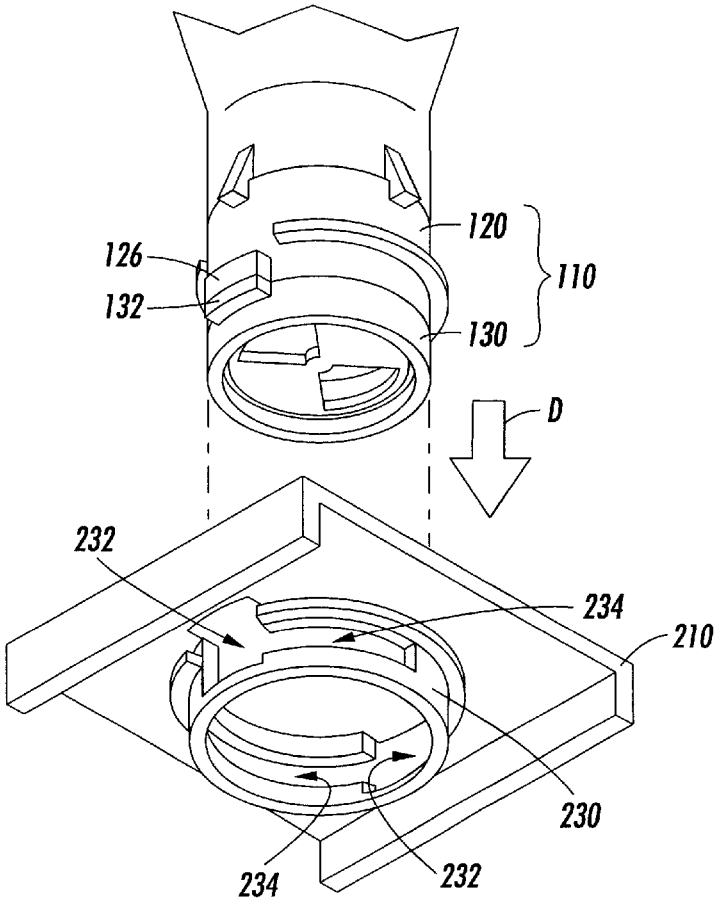
FIG. 8 is a perspective view of the first exemplary embodiment of the toner bottle valve and the bottom of the toner hopper adaptor of the invention prior to engaging the toner bottle valve with the toner hopper adaptor.
Figure 9:
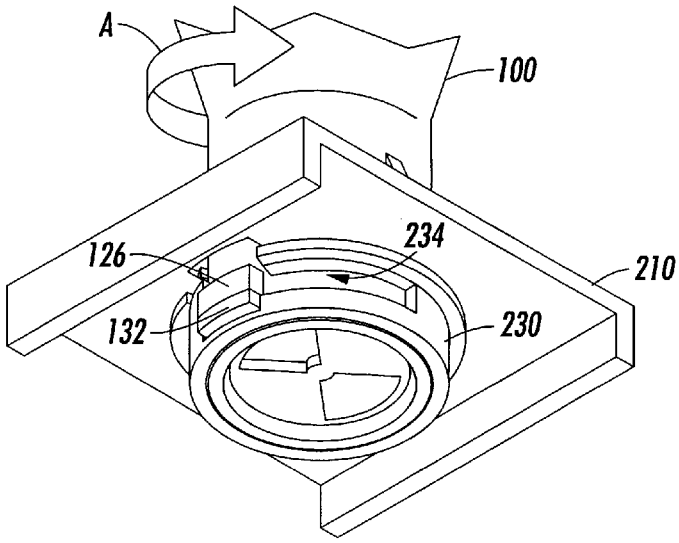
FIG. 9 is a perspective view of the first exemplary embodiment of the toner bottle valve and the bottom of the toner hopper adaptor of the invention after engaging the toner bottle valve with the toner hopper adaptor.

Referring to FIGS. 7 and 8, the tabs 126 and 132 of the first and second valve members 120 and 130, respectively, are aligned and the apertures 128 and 136 of the first and second valve members 120 and 130, respectively, are not overlapping. Thus, toner cannot be dispensed from the toner bottle 100. The toner bottle 100 is aligned with the toner hopper adaptor 210 so that the tabs 126 and 132 are aligned with the recesses 220. As shown in FIG. 8, the toner bottle 100 is moved in the direction of arrow D until the toner bottle 100 is in the position shown in FIG. 9. As shown in FIG. 9, the tabs 126 and 132 fit into the slot 232 of the annular projection 18. The tab 132 of the second valve member 130 fits into the bottom of the slot 232 so that the second valve member 130 cannot rotate relative to the toner hopper adaptor 210. The tab 126 of the first valve member 120 is aligned with the groove 234 extending from the slot 232.

Figure 10:
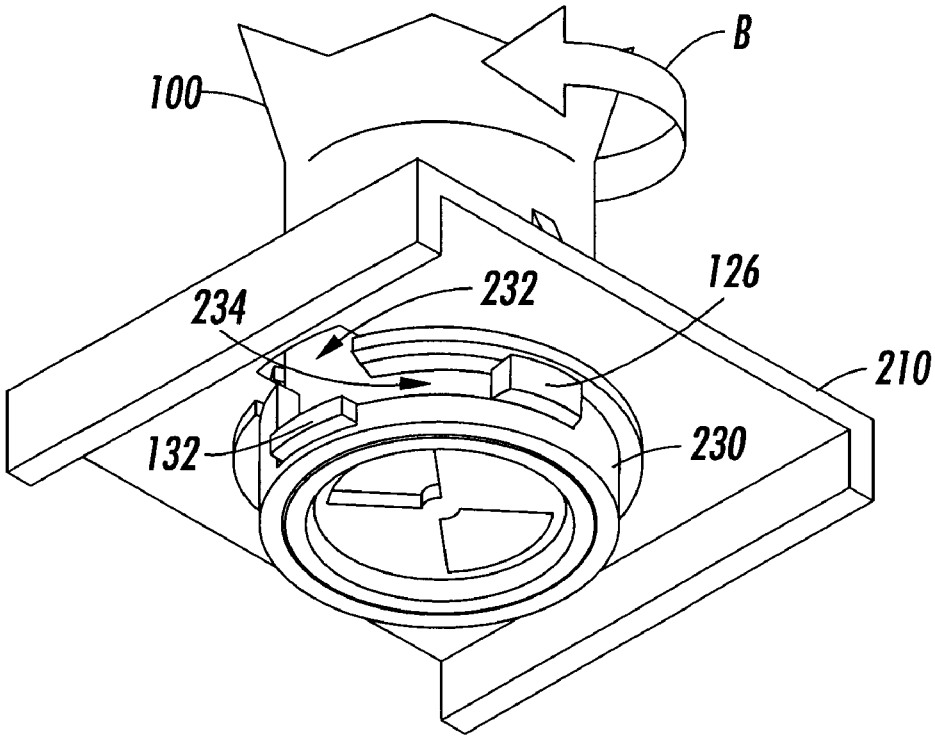
FIG. 10 is a perspective view of the first exemplary embodiment of the toner bottle valve and the bottom of the toner hopper adaptor of the invention after rotating the first valve member relative to the second valve member.

As shown in FIG. 9, the toner bottle 100, and thus the first valve member 120 may be rotated in the direction of arrow A. As the first valve member 120 is rotated relative to the second valve member 130, the apertures 128 begin to overlap the apertures 136. The toner bottle 100 may be rotated until the tab 126 reaches the end of the groove 234 as shown in FIG. 10. In this position, the tabs 126 and 132 are offset approximately 90° from each other and the apertures 128 completely overlap the apertures 136. The toner can be dispensed from the toner bottle 100. In this position, the toner bottle 100 may not be disengaged from the toner hopper 10 as the tab 126 of the first valve member 120 is engaged in the groove 234 of the toner hopper adaptor 210, thus preventing possible spilling of the toner.

As shown in FIGS. 1 and 7, the annular shelf 124 of the first valve member 120 has a larger diameter than the annular projection 230 of the toner hopper adaptor 210 and a larger diameter than the aperture 12 of the hopper slider 14. When the first and second valve members 120 and 130 are inserted into the toner hopper adaptor 210, the annular shelf 124 engages the top of the toner hopper adaptor 210 and supports the toner bottle 100. The operator can safely release the toner bottle 100 without the toner bottle 100 tipping over and disengaging from the toner hopper adaptor 210.

After the toner bottle 100 is engaged with the toner hopper adaptor 210 and rotated to open the toner bottle valve 110, as shown in FIGS. 9 and 10, the toner bottle 100 is translated back and forth along the toner hopper 10 by sliding the hopper slider 14 in the direction of arrow C as shown in FIG. 1 to evenly distribute the toner in the toner hopper 10. A label or other indicia may instruct the operator to translate the toner bottle 100 back and forth. The toner bottle 100 cannot disengage from the toner hopper adaptor 210 as the tab 126 of the first valve member 120 is firmly held in the groove 234, as shown in FIG. 10. The annular shelf 124 of the first valve member 120 also supports the toner bottle 100 and prevents the toner bottle 100 from tipping over during translation of the toner bottle 100 back and forth on the toner hopper 10.

Referring again to FIGS. 9 and 10, to release the toner bottle 100 from the toner hopper adaptor 210, the toner bottle 100 is rotated in the direction of arrow B until the tabs 126 and 132 are aligned as shown in FIG. 9. Once the tabs 126 and 132 are aligned, the apertures 128 and 136 of the first and second valve members 120 and 130, respectively, no longer overlap and no toner may be dispensed. The toner bottle 100 may be disengaged from the toner hopper adaptor 210 without spilling toner.

Figure 11:
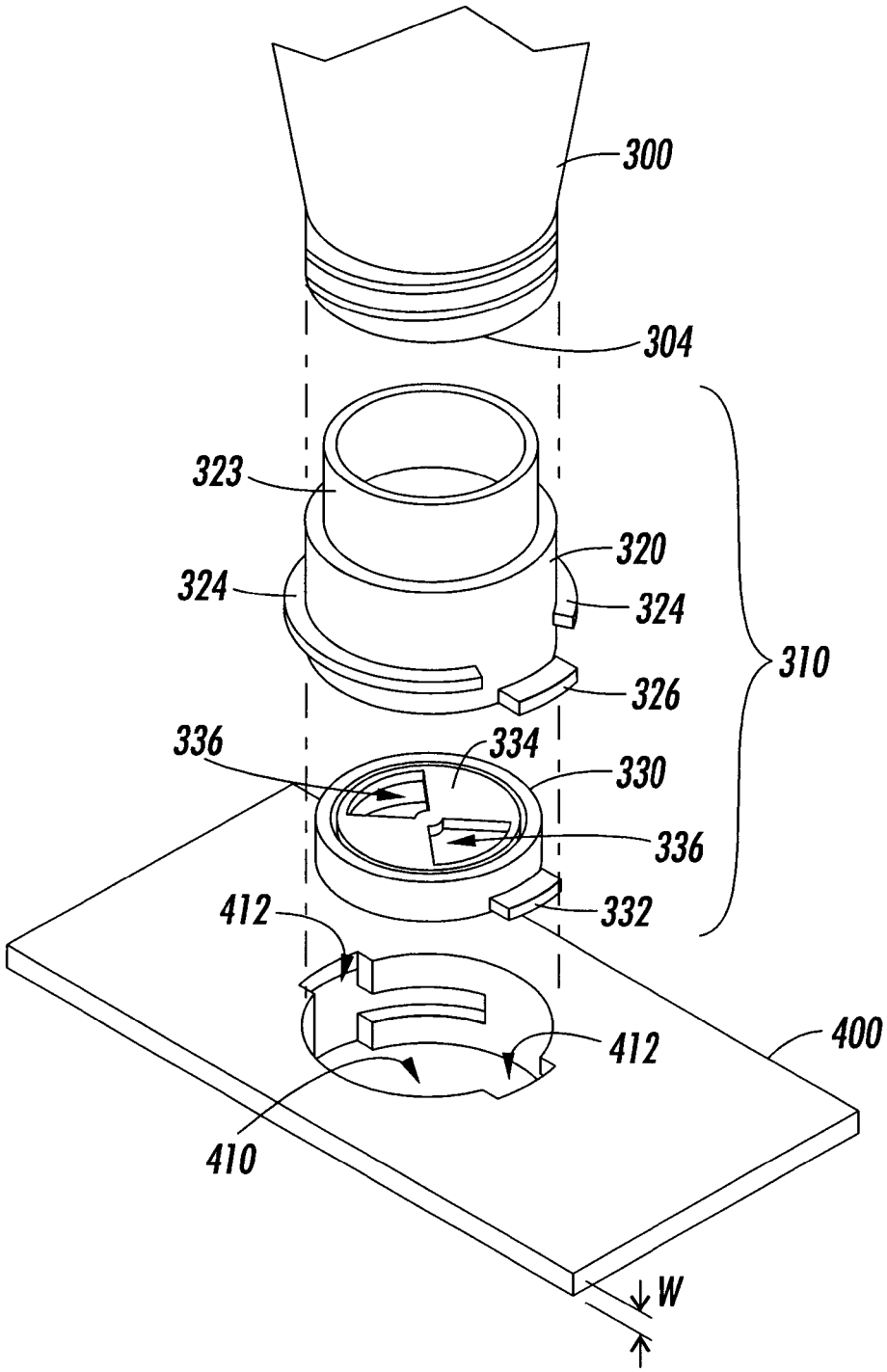
FIG. 11 is an exploded assembly view of a second exemplary embodiment of a toner loading system according to the invention.

Referring to FIGS. 11–14, in a second exemplary embodiment of the toner loading system according to the invention, a toner bottle valve 310 includes a first valve member 320 mounted on a toner bottle 300. The first valve member 320 includes a reduced diameter portion 323 that is smaller in diameter than the diameter of the opening 304 of the toner bottle 300. The reduced diameter portion 323 is press fit into the opening of the toner bottle 300 so that the first valve member 320 is non-rotatably secured to the toner bottle 300. The first valve member 320 includes an annular shelf 324 and tabs 326, only one of which is shown in FIG. 11.

Figure 14:
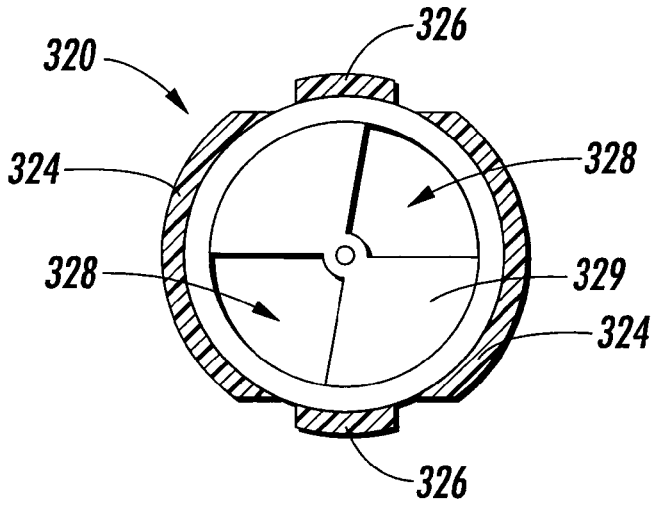
FIG. 14 is a top sectional view of the first valve member shown in FIG. 11.
Figure 15:
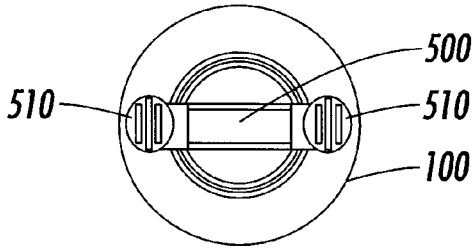
FIG. 15 is a top plan view of one exemplary embodiment of a toner bottle and cop of a third exemplary embodiment of a toner loading system according to the invention.
Figure 16:
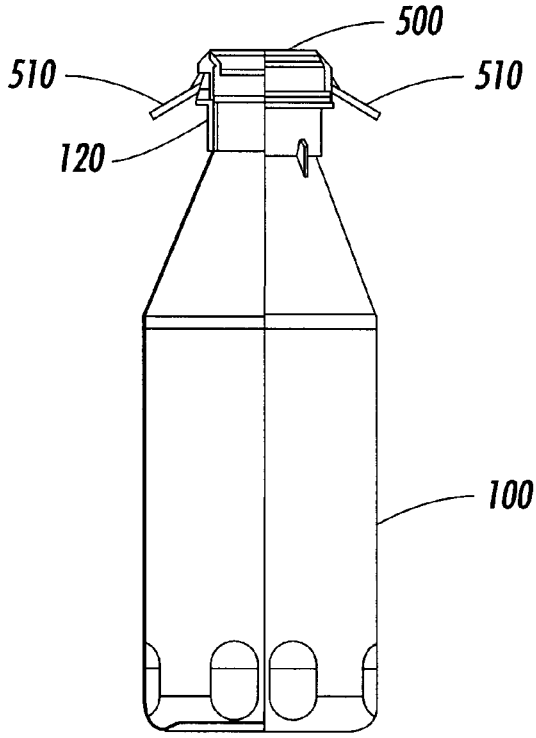
FIG. 16 is a side view of the toner bottle and cap shown in FIG. 15.
Figure 17:
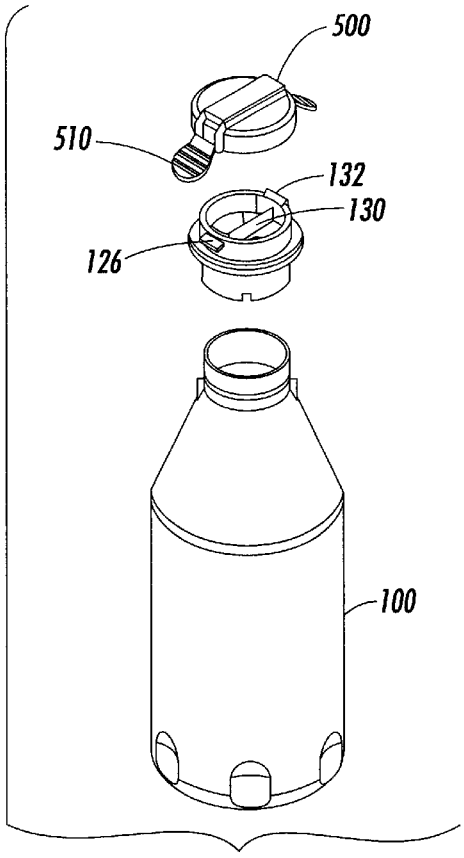
FIG. 17 is an exploded assembly view of the toner bottle, the toner bottle valve and cap shown in FIG 15.

A second valve member 330 is rotatably secured in the first valve member 320 in a manner similar to the first and second valve members 120 and 130 of the first exemplary embodiment. The second valve member 330 includes apertures 336 and tabs 332, only one tab 332 being shown in FIG. 11. As shown in FIG. 14, the apertures 336 of the second valve member 330 do not overlap apertures 328 in the first valve member 320 when the tabs 326 are aligned with the tabs 332. As in the first exemplary embodiment, the apertures 328 of the first valve member 320 and the apertures 336 of the second valve member 330 extend for less than 90° of the circumference of the first and second valve members 320 and 330, respectively. Although two apertures 328 and 336 are shown for each of the first and second valve members 320 and 330, respectively, it should be appreciated that the corresponding number of apertures in the first and second valve members 320 and 330 may include any number of corresponding apertures with the angular extent of the apertures adjusted correspondingly to ensure that a complete seal is formed.

Figure 12:
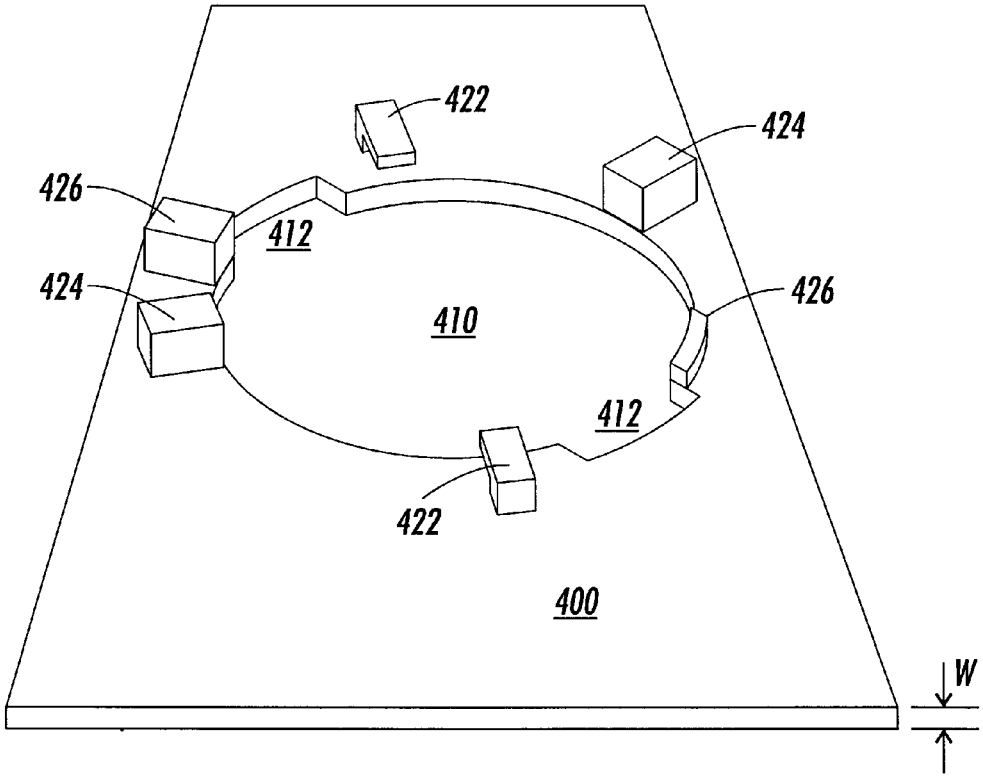
FIG. 12 is a perspective view of one exemplary embodiment of a bottom of a hopper slider according to the second exemplary embodiment of the toner loading system shown in FIG. 11.
Figure 13:
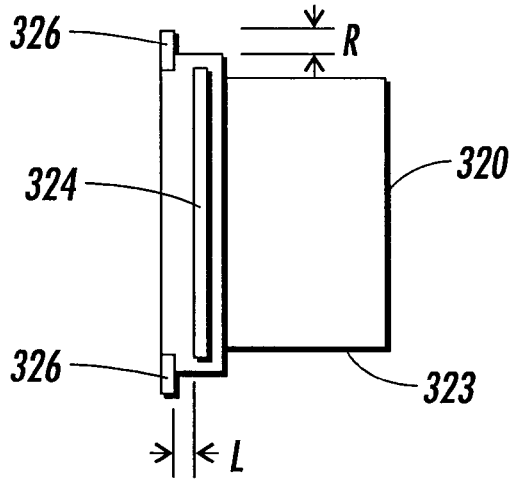
FIG. 13 is a side view of one exemplary embodiment of a first valve member according to the second exemplary embodiment of the toner loading system shown in FIG. 11.

The second exemplary embodiment of the toner loading system includes a hopper slider 400 that is secured to the hopper 10 and that is slidably supported by the toner hopper 10. The hopper slider 400 may replace existing hopper sliders used on existing toner hoppers installed on existing image forming apparatus or the hopper slider 400 may be originally installed in new or existing image forming apparatus. Referring to FIG. 11, the hopper slider 400 is generally planar and has an aperture 410 that includes a number of recesses 412. The recesses 412 accept the tabs 326 and 332 when the tabs 326 and 332 are aligned and the toner bottle 300 is sealed. As shown in FIG. 12, the bottom of the hopper slider 400 includes first retaining stops 422, second retaining stops 424 and release stops 426.

To dispense toner, the toner bottle 300 is moved toward the hopper slider 400 and the tabs 326 and 332 pass through the recesses 412. The diameter of the annular shelf 324 is larger than the diameter of the aperture 410 and prevents the first valve member 320 from passing entirely through the aperture 410. The annular shelf 324 also supports the toner bottle 300 on the hopper slider 400 and prevents the toner bottle 300 from tilting when the hopper slider 400 and the toner bottle 300 are translated back and forth to evenly distribute the toner in the toner hopper 10.

Once the annular shelf 324 is engaged with the top of the hopper slider 400, the operator can rotate the toner bottle 300. The toner bottle 300 is rotated and the tabs 332 of the second valve member 330 engage the first retaining stops 422. The second valve member 330 is prevented from rotating any further by engaging the tabs 332 with the first retaining stops 422. The toner bottle 300 and the first valve member 320 may be further rotated until the tabs 326 of the first valve member 320 engage the second retaining stops 424. When the tabs 326 and 332 are not aligned, the apertures 328 of the first valve member 320 overlap the apertures 336 of the second valve member 330 and toner may be dispensed.

The toner slider 400 may be translated back and forth on the toner hopper 10 to evenly distribute the toner. Once the toner hopper 10 is replenished, the toner bottle 300 is rotated in the opposite direction until the tabs 326 and 332 are realigned. Once the tabs 326 and 332 are realigned, the apertures 328 and 336 of the first and second valve members 320 and 330 no longer overlap and the toner bottle 300 is sealed. The release stops 426 engage the tabs 326 and 332 and prevent the toner bottle 300 from being rotated past the recesses 412 and keep the tabs 326 and 332 aligned with the recesses 412. The toner bottle 300 may then be removed from the hopper slider 400 without spilling the toner.

Referring to FIGS. 11–14, an axial distance L between the annular shelf 324 and the tabs 326 of the first valve member 320 may be approximately equal to the thickness W of the hopper slider 400. This arrangement ensures a proper fit between the first valve member 320 and the hopper slider 400 and prevents the first valve member 320 from tilting or pivoting when engaged with the hopper slider 400. A radial width R of the tabs 326 may be equal to twice the thickness W of the hopper slider 400.

As in the first exemplary embodiment, a surface member 334 may have a convex shape. As shown in FIG. 11, the apertures 336 may be formed in the surface member 334. A flexible surface member 329 of the first valve member 320 sealingly engages the surface member 334 of the second valve member 330. As shown in FIG. 14, the apertures 328 may be formed in the flexible surface member 329. It should also be appreciated that the convex surface member may be provided on the first valve member 320 and the flexible surface member may be provided on the second valve member 330.

Referring to FIGS. 15–18, a third exemplary embodiment of the toner loading system according to the invention includes the toner bottle 100, the first valve member 120 and the second valve member 130. A cap 500 is placed over the second valve member 130. The cap 500 maintains alignment of the tab 126 in the first valve member 120 and the tab 132 of the second valve member 130, respectively, during shipping and storage of the toner bottle 100, so that the toner bottle 100 remains sealed.

Figure 18:
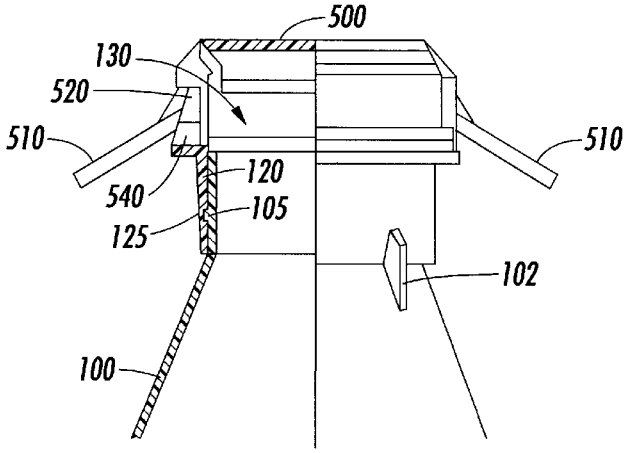
FIG. 18 is an enlarged view of the toner bottle, the first and second valve members and the cap shown in FIGS. 15–17.

As shown in FIG. 18, levers 510 are connected to the cap 500 by, for example, a living hinge 520. The tips of the levers 510 act as snap fit retainers to keep the cap 500 in position during transit and storage. The tips of the levers 510 engage below the tabs 126 on the first valve member 120. By squeezing the levers 510 towards each other the living hinges 520 rotate and the cap 510 can be disengaged from the first valve member 120. The cap 510 is disengaged from the first valve member 120 prior to loading the toner and the second valve member 130 is then rotatable relative to the first valve member 120 and toner may be dispensed from the toner bottle 100.

A ring of sealing material 540, for example foam, is fitted in around the first valve member 120. The ring of sealing material 540 may be secured to the first valve member 120 by an adhesive. The ring of sealing material 540 provides additional protection against toner leakage and/or spillage. The first valve member 120 is assembled externally to the toner bottle 100 and is retained and sealed by a ridge 105 around the neck of the toner bottle 100 and a mating groove 125 inside the first valve member 120. Rotation of the first valve member 120 relative to the toner bottle 100 is prevented by the engagement of the lugs 102 and the slots 122.

Figure 19:
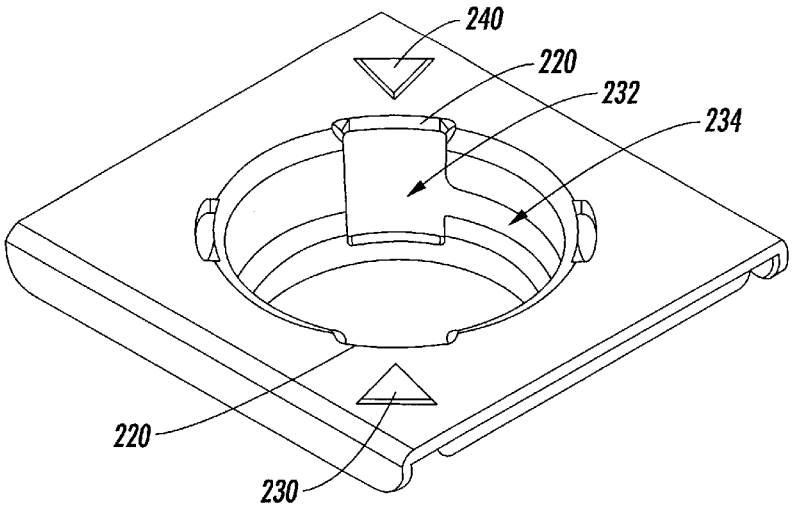
FIG. 19 is a perspective view of one exemplary embodiment of a top of a toner hopper adaptor according to the invention.
Figure 20:
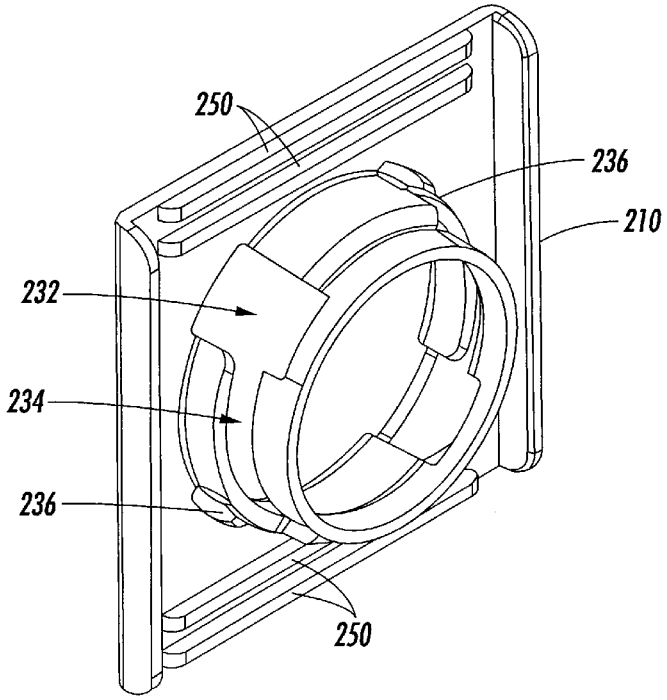
FIG. 20 is a perspective view of a bottom of the toner hopper adaptor shown in FIG. 19.

Referring to FIGS. 19 and 20, in a third exemplary embodiment of a toner hopper adaptor 200 according to this invention, the toner hopper adaptor 200 includes indicia 230 and 240 for indicating the recesses 220 that accept the tabs 126 and 132 of the first and second valve members 120 and 130. The toner hopper adaptor 200 also includes ribs 250 on the bottom to increase the stiffness of the toner hopper adaptor 200.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A toner loading system, comprising:

a first valve member non-rotatably securable to a toner bottle, the first valve member including at least one first tab on an outer surface, and a first aperture;

a second valve member rotatably securable to the first valve member, the second valve member including at least one second tab on an outer surface and a second aperture; and a valve opening slider member slidably securable to a toner hopper for back and forth movement along an axis of the toner hopper, the valve slider member including a third aperture;

wherein the first and second apertures do not overlap when the at least one first tab is aligned with the at least one second tab and overlap when the at least one first tab and the at least one second tab are not aligned.

2. A toner loading system, comprising:

a first valve member non-rotatably securable to a toner bottle, the first valve member including at least one first tab on an outer surface, and a first aperture;

a second valve member rotatably securable to the first valve member, the second valve member including at least one second tab on an outer surface and a second aperture; and a valve opening member movably securable to a toner hopper, the valve opening member including a third aperture;

wherein the first and second apertures do not overlap when the at least one first tab is aligned with the at least one second tab and overlap when the at least one first tab and the at least one second tab are not aligned, and the third aperture includes at least one recess and the second valve member and at least a portion of the first valve member are able to pass through the third aperture when the at least one first tab and the at least one second tab are aligned with the at least one recess.

3. The toner loading system of claim 2, wherein the first valve member includes a shelf on the outer surface that engages the valve opening member and prevents the first valve member from passing entirely through the third aperture.

4. The toner loading system of claim 3, wherein a distance between the shelf and the at least one first tab is equal to a thickness of the valve opening member.

5. The toner loading system of claim 2, wherein the valve opening member further includes indicia indicating the recess.

6. The toner loading system of claim 2, wherein the valve opening member further comprises an annular projection extending from the third aperture, the annular projection including at least one slot aligned with the at least one recess and at least one groove, for each slot, extending from that slot.

7. The toner loading system of claim 6, wherein for each slot, each at least one second tab is non-rotatably engageable in a corresponding one of the at least one slot and the at least one first tab is rotatable in a corresponding one of the at least one groove.

8. The toner loading system of claim 2, wherein the valve opening member further comprises at least one first retaining stop, at least one second retaining stop, and at least one release stop.

9. The toner loading system of claim 8, wherein the at least one second tab engages the at least one first retaining stop to prevent rotation of the second valve member relative to the valve opening member and the first valve member may be rotated relative to the second valve member until the at least one first tab engages the at least one second retaining stop.

10. The toner loading system of claim 8, wherein the at least one release stop engages both the at least one first tab and the at least one second tabs and prevents rotation of the first and second valve members relative to the valve opening member.

11. The toner loading system of claim 2, wherein the valve opening member further comprises at least one rib.

12. A toner loading system, comprising:

a first valve member non-rotatably securable to a toner bottle, the first valve member including at least one first tab on an outer surface, and a first aperture;

a second valve member rotatably securable to the first valve member, the second valve member including at least one second tab on an outer surface and a second aperture; and a valve opening member movably securable to a toner hopper, the valve opening member including a third aperture;

wherein the first and second apertures do not overlap when the at least one first tab is aligned with the at least one second tab and overlap when the at least one first tab and the at least one second tab are not aligned, and a length of each at least one first tab is equal to twice the thickness of the valve opening member.

13. A toner loading system, comprising:

a first valve member non-rotatably securable to a toner bottle, the first valve member including at least one first tab on an outer surface, and a first aperture;

a second valve member rotatably securable to the first valve member, the second valve member including at least one second tab on an outer surface and a second aperture; and a valve opening member movably securable to a toner hopper, the valve opening member including a third aperture;

wherein the first and second apertures do not overlap when the at least one first tab is aligned with the at least one second tab and overlap when the at least one first tab and the at least one second tab are not aligned, the toner loading system further comprising a cap placeable over the second valve member, wherein the cap is connected to the first valve member.

14. The toner loading system of claim 13, wherein:

the cap includes a lever connected to the first valve member; and pivoting the lever disconnects the cap from the first valve member.

15. A toner loading system, comprising:

a first valve member non-rotatably securable to a toner bottle, the first valve member including at least one first tab on an outer surface, and a first aperture;

a second valve member rotatably securable to the first valve member, the second valve member including at least one second tab on an outer surface and a second aperture; and a valve opening member movably securable to a toner hopper, the valve opening member including a third aperture;

wherein the first and second apertures do not overlap when the at least one first tab is aligned with the at least one second tab and overlap when the at least one first tab and the at least one second tab are not aligned and:

the second valve member includes a convex surface in which the second aperture is formed;

the first valve member includes a flexible surface in which the first aperture is formed; and the convex surface is sealingly engageable with the flexible surface.

16. A valve, comprising:

a first valve member non-rotatably securable to a container, the first valve member including at least one first tab and a shelf on an outer surface, and a first aperture; and a second valve member rotatably securable to the first valve member, the second valve member including at least one second tab on an outer surface and a second aperture, wherein the first and second apertures do not overlap when the at least one first tab is aligned with the at least one second tab and overlap when the at least one first tab and the at least one second tab are not aligned.

17. A valve, comprising:

a first valve member non-rotatably securable to a container, the first valve member including at least one first tab on an outer surface, and a first aperture; and a second valve member rotatably securable to the first valve member, the second valve member including at least one second tab on an outer surface and a second aperture, wherein the first and second apertures do not overlap when the at least one first tab is aligned with the at least one second tab and overlap when the at least one first tab and the at least one second tab are not aligned and wherein:

the second valve member includes a convex surface in which the second aperture is formed;

the first valve member includes a flexible surface in which the first aperture is formed; and the convex surface is sealingly engageable with the flexible surface.

18. A valve, comprising:

a first valve member non-rotatably securable to a container, the first valve member including at least one first tab on an outer surface, and a first aperture; and a second valve member rotatably securable to the first valve member, the second valve member including at least one second tab on an outer surface and a second aperture, wherein the first and second apertures do not overlap when the at least one first tab is aligned with the at least one second tab and overlap when the at least one first tab and the at least one second tab are not aligned, the valve further comprising a cap placeable over the second valve member, wherein the cap is connected to the first valve member.

19. The toner loading system of claim 18, wherein:

the cap includes a lever connected to first valve member; and pivoting the lever disconnects the cap from the first valve member.

20. A valve, comprising:

a first valve member non-rotatably securable to a container, the first valve member including at least one first tab on an outer surface, and a first aperture; and a second valve member rotatably securable to the first valve member, the second valve member including at least one second tab on an outer surface and a second aperture, wherein the first and second apertures do not overlap when the at least one first tab is aligned with the at least one second tab and overlap when the at least one first tab and the at least one second tab are not aligned; and a valve opening member that engages with the first valve member and the second valve member to open a valve formed by the first valve member and the second valve member, the valve opening member comprising:

an aperture including at least one recess;

wherein the second valve member and at least a portion of the first valve member are able to pass through the aperture when the at least one first tab and the at least one second tab are aligned with the at least one recess.

21. The valve opening member of claim 20, further comprising an annular projection extending from the aperture, the annular projection including at least one slot aligned with the at least one recess and at least one groove, for each slot, extending from that slot.

22. The valve opening member of claim 21, wherein for each slot, each at least one second tab is non-rotatably engageable in a corresponding one of the at least one slot and the at least one first tab is rotatable in a corresponding one of the at least one groove.

23. The valve opening member of claim 20, wherein the valve opening member further comprises at least one first retaining stop, at least one second retaining stop, and at least one release stop.

24. The valve opening member of claim 23, wherein the at least one second tab engages the at least one first retaining stop to prevent rotation of the second valve member relative to the valve opening member and the first valve member may be rotated relative to the second valve member until the at least one first tab engages the at least one second retaining stop.

25. The valve opening member of claim 23, wherein the at least one release stop engages both the at least one first tab and the at least one second tab and prevents rotation of the first and second valve members relative to the valve opening member.

26. The valve opening member of claim 20, further comprising indicia indicating the recess.

27. The valve opening member of claim 20, further comprising at least one rib.

* * * * *